US006848973B2

(12) United States Patent
Bellemare

(10) Patent No.: US 6,848,973 B2
(45) Date of Patent: Feb. 1, 2005

(54) METHOD FOR BLAST CLEANING USING ILMENITE TAILING PARTICLES

(75) Inventor: Serge Bellemare, Trois-Rivières (CA)

(73) Assignee: Sable des Forgens, Trois-Rivières (CA)

( * ) Notice: Subject to any disclaimer, the term of this patent is extended or adjusted under 35 U.S.C. 154(b) by 0 days.

(21) Appl. No.: 10/386,703

(22) Filed: Mar. 13, 2003

(65) Prior Publication Data

US 2004/0180609 A1 Sep. 16, 2004

(51) Int. Cl.[7] ..... B24B 1/00

(52) U.S. Cl. ..... 451/36; 451/38; 451/39; 451/40; 51/309

(58) Field of Search ..... 451/36–38, 39, 451/40; 51/307, 308, 309

(56) References Cited

U.S. PATENT DOCUMENTS

| | | | | | |
|---|---|---|---|---|---|
| 3,615,308 | A | * | 10/1971 | Amero | 51/309 |
| 3,781,172 | A | * | 12/1973 | Pett et al. | 51/309 |
| 3,929,987 | A | * | 12/1975 | Colodney et al. | 424/52 |
| 3,955,942 | A | * | 5/1976 | Cordon et al. | 51/295 |
| 5,280,836 | A | * | 1/1994 | Kindig | 209/1 |
| 5,304,226 | A | * | 4/1994 | Hasegawa et al. | 51/309 |
| 5,525,135 | A | * | 6/1996 | Moltgen et al. | 51/309 |
| 5,637,030 | A | * | 6/1997 | Chopra et al. | 451/39 |
| 6,124,030 | A | * | 9/2000 | Suzuki et al. | 428/328 |
| 6,152,976 | A | * | 11/2000 | Ishitobi et al. | 51/309 |
| 6,478,837 | B1 | * | 11/2002 | Miyata | 51/309 |

FOREIGN PATENT DOCUMENTS

| | | | |
|---|---|---|---|
| GB | 2 066 876 A | * | 7/1981 |
| JP | 59053613 | | 3/1984 |
| JP | 62039683 | | 2/1987 |

* cited by examiner

*Primary Examiner*—M. Rachuba
(74) *Attorney, Agent, or Firm*—Ogilvy Renault; Paul Marcoux

(57) ABSTRACT

The invention relates to a method for blast cleaning using ilmenite tailings particles between 10 mesh and 250 mesh as impact abrasive material. Ilmenite tailing particles are a waste product obtained in a beneficiation plant of an ilmenite ore ($FeTiO_3$) metallurgical complex. The particles are preferably washed, dried, and screened before being used as impact abrasive material. They are separated in particle-size range to improve their efficiency for blast cleaning.

7 Claims, No Drawings

METHOD FOR BLAST CLEANING USING ILMENITE TAILING PARTICLES

BACKGROUND OF THE INVENTION (a) Field of the Invention

The present invention relates to a method for blast cleaning using ilmenite tailing particles as impact abrasive material.

(b) Description of Prior Art

Due to its high hardness and low cost, silica sand has been used extensively for impact abrasion. It is, however, very brittle with most grains disintegrating on impact, causing excessive levels of siliceous dust which is a major health hazard and causes serious environmental pollution. Consequently, it has been banned as impact abrasive material in most countries around the world. Considerable research has been done in the last twenty (20) years to find an impact abrasive material as hard as silica sand and that respects North American norms for dust emissions. Furthermore, the impact abrasive material must be cost effective. Usually characterized by a high hardness, mineral slags such as those containing copper, nickel, iron (JP 59053613), and alloys (JP 62039683) have been used. These slags are quenched from molten state with cold water and crushed and/or grinded, giving each particle a glassy brittle structure with distinct fracture lines. Upon blasting impact, the slag particle shatters into minute particles and become airborne due to their small size and low specific gravity, resulting in the generation of high dust levels. Moreover, these slags, especially the copper slag and nickel slag, are waste products of the metals refining industry and frequently contain unacceptable levels of toxic heavy metals such as lead, copper, zinc, arsenic and cadmium, etc. Finally, slag crushing and/or grinding are energetically inefficient processes which increase the cost of impact abrasive materials. There therefore exists a need for a new impact abrasive material for blast cleaning which respects governmental norms for dust emissions and is cost efficient.

SUMMARY OF THE INVENTION

It is an object of the present invention to overcome the problems mentioned previously.

It is another object of the invention to provide a blast cleaning method wherein the impact abrasive material comprises ilmenite tailing particles.

The above and other objects of the invention may be achieved by providing a method for blast cleaning a surface by projecting an impact abrasive material against that surface, wherein the impact material comprises ilmenite tailing particles having a particle-size range between 10 mesh and 250 mesh (between 1.68 mm and 68 $\mu$m).

The preferred impact abrasive material comprises a waste product obtained in a beneficiation plant of an ilmenite ore ($FeTiO_3$) metallurgical complex.

In accordance with a preferred embodiment, the ilmenite tailing particles are washed, dried, and screened to the above particle-size range before being used as impact abrasive material.

When used as impact abrasive material for treating the surface of a truck, an industrial equipment, or a surface characterized by deep cavities, the ilmenite tailing particles preferably have a particle-size range between 10 mesh and 30 mesh (1.68 mm to 550 $\mu$m).

On the other hand, when the impact abrasive material according to the invention is used for treating the surface of a car or a new metal, the ilmenite tailing particles preferably have a particle-size range between 30 mesh and 70 mesh (550 $\mu$m to 200 $\mu$m).

DETAILED DESCRIPTION OF THE INVENTION

Ilmenite tailings are a granite dark gray and brown mineral and constitute a waste product of a beneficiation plant of an ilmenite ore ($FeTiO_3$) metallurgical complex.

The extracted ore from the mine, containing mainly anorthosite combined with iron and titanium oxides, is first crushed and, then, separated mechanically with spirals. The lightest particles, containing mainly silicates, go directly to the tailings while the heaviest particles, containing mainly ilmenite, are sent to rotary dryers. During the drying process, hematite ($Fe_2O_3$) and pyrite ($FeS_2$) are transformed into magnetite ($Fe_3O_4$) with magnetic properties. Titanium is bonded chemically to the iron oxides. The magnetic and non-magnetic parts of the ore are separated through a magnetic separator. The magnetic ore, containing mainly the iron and titanium oxides, is sent to the reduction plant of the metallurgical complex to be melted, separated, and purified while the non-magnetic part, containing mainly silicates, goes to the tailings. To be used for blast cleaning, the ilmenite tailing is preferably washed, dried, and screened.

It was surprisingly been found that ilmenite tailing can be used for blast cleaning since it is characterized by a high hardness giving a high impact resistance (6.0–6.5 MOHS for the ilmenite tailing comparatively to 6.5–7.0 MOHS for silica sand). Its density is approximately 1500 $kg \cdot m^{-3}$. Moreover, it respects the governmental norms for dust emissions since silica is strongly bonded with other compounds or elements (sodium, aluminum, potassium, magnesium, iodine, and fluorine). Consequently, free silica released is low. Furthermore, environmental norms for dust emission are met for silver, aluminum, arsenic, barium, calcium, cadmium, cobalt, chrome, copper, iron, lithium, magnesium, manganese, nickel, lead, tellurium, titanium, thallium, and zinc. Finally, ilmenite tailing is cost efficient since it is a waste from a previous industry and no further fragmentation (crushing or grinding) or complex treatment is required.

To improve blast cleaning efficiency, the ilmenite tailing particles are preferably screened and separated in different sizes. In accordance with the invention, the maximum efficiency is reached for particles between 10 mesh and 250 mesh (1.68 mm and 68 $\mu$m). The bigger particles are efficient to clean objects that are covered with a thick or highly adhesive layer of oxides while the finer ones are efficient to clean objects that are covered with a thin or new layer of oxides. Using bigger particles requires a bigger nozzle diameter. For example, ilmenite tailing particles characterized by 60% of the particles retained on 10 mesh to 20 mesh (1.68 mm to 841 $\mu$m) sieves can be used to eliminate thick or highly adhesive rust from an object. To blast the particles on the object, a nozzle with a minimum diameter of ¼" (0.635 cm) is recommended. To eliminate rust from trucks, industrial equipment, or in deep cavities (hollow), ilmenite tailing particles characterized by 60% of the particles retained on 20 mesh to 30 mesh (841 $\mu$m to 550 $\mu$m) sieves are used and a nozzle with a minimum diameter of 3/16" (0.476 cm) is recommended. For bridges, boats, heavy machinery, trucks, and industrial equipment, ilmenite tailing particles characterized by 60% of the particles retained on 16 mesh to 60 mesh (1 mm to 250 μm) sieves are used and a nozzle with a minimum diameter of 3/16" (0.476 cm) is also recommended. Ilmenite tailing particles characterized by 60% of the particles retained on 30 mesh to 60 mesh (550 μm to 250 μm) sieves or 35 mesh to 70 mesh (420 μm to 200 μm) sieves give good results for new steel, cars, and weak rust when it is blasted with a 3/16" nozzle minimum. It should be well understood that the previous illustrations are given as examples. A person skilled in the art might envisage several variants for specific applications. Therefore, the previous description should be considered as illustrations of invention rather than limitative uses.

For good results, the ilmenite tailings must be kept dry and not contaminated to ensure a continuous flow. A small sieve is recommended on the ilmenite tailing tank to avoid too larger particles. The ilmenite tailing is non-explosive, uninflammable, stable under normal operating conditions. It does not present specific danger for health, except when small particles are located in the eyes. In this case, normal medical cares should be applied. In case of accidental discharge, the same procedures than for the sand should be applied. Similar precautions as a person skilled in the art would apply for other blasting abrasives should be applied when using ilmenite tailings for blast cleaning.

It is understood that the invention is not limited to the above preferred embodiments and that it covers any modifications thereto, within the scope of the appended claims.

I claim:

1. A method for blast cleaning a surface comprising projecting an impact abrasive material against said surface under conditions to remove at least some material from said surface, wherein said impact abrasive material includes ilmenite tailing particles, said particles having a particle-size ranging between 10 mesh and 250 mesh (1.68 mm and 68 μm).

2. The method according to claim 1, wherein said particles are a waste product obtained in a beneficiation plant to recover said ilmenite from said ore.

3. The method according to claim 2, further comprising washing, drying, and screening said particles before using said particles as said impact abrasive material.

4. The method according to claim 2, wherein 60 wt % of said particles have a particle-size range between 10 mesh to 20 mesh (1.68 mm to 841 μm).

5. The method according to claim 2, wherein 60 wt % of said particles have a particle-size range between 20 mesh to 30 mesh (841 μm to 550 μm).

6. The method according to claim 2, wherein 60 wt % of said particles have a particle-size range between 16 mesh to 60 mesh (1 mm to 250 μm).

7. The method according to claim 2, wherein 60 wt % of said particles have a particle-size range between 30 mesh to 70 mesh (550 μm to 200 μm).

* * * * *

UNITED STATES PATENT AND TRADEMARK OFFICE

CERTIFICATE OF CORRECTION

PATENT NO. : 6,848,973 B2
DATED : February 1, 2005
INVENTOR(S) : Bellemare

It is certified that error appears in the above-identified patent and that said Letters Patent is hereby corrected as shown below:

Title page,
Item [73], Assignee, delete "Sable des Forgens," and insert -- Bellemare Des Forges Inc., --.

Signed and Sealed this

Thirty-first Day of January, 2006

JON W. DUDAS
*Director of the United States Patent and Trademark Office*